US006405696B1

(12) United States Patent
Borraccia et al.

(10) Patent No.: US 6,405,696 B1
(45) **Date of Patent: *Jun. 18, 2002**

(54) SPLINE-TYPE CAM PHASER

(75) Inventors: Dominic Borraccia, Spencerport; Matthew T. Scott, West Henrietta; Jason M. Urckfitz, Brockport; Timothy M. Nieves, Geneseo; Thomas H. Lichti, Fairport, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/894,772

(22) Filed: Jun. 28, 2001

(51) Int. Cl.[7] ..... F01L 1/344
(52) U.S. Cl. ..... 123/90.17; 123/90.37
(58) Field of Search ..... 123/90.15, 90.17, 123/90.31, 90.33, 90.34, 90.37; 74/568 R

(56) References Cited

U.S. PATENT DOCUMENTS 5,588,404 A * 12/1996 Lichti et al. ..... 123/90.17
5,870,983 A * 2/1999 Sato et al. ..... 123/90.17
5,875,751 A * 3/1999 Strauss et al. ..... 123/90.17
5,970,930 A * 10/1999 Scheidt et al. ..... 123/90.17
6,089,198 A * 7/2000 Goppelt et al. ..... 123/90.17
6,116,200 A * 9/2000 Abts et al. ..... 123/90.17

* cited by examiner

*Primary Examiner*—Weilun Lo
(74) *Attorney, Agent, or Firm*—John Van Ophem

(57) ABSTRACT

An improved splined cam phaser includes four assemblies: a sprocket assembly, an inner hub assembly, a cover assembly, and a piston assembly. The joined assemblies provide phaser function at reduced manufacturing cost. The component parts of the assemblies are re-configured from analogous parts in the prior art cam phaser to permit much of the improved phaser to be manufactured inexpensively by powdered metal forming or by stamping or drawing from sheet metal, in contrast with the prior art phaser wherein all parts are formed expensively either by machining from forged blanks or by investment casting. These changes reduce not only the cost of manufacture but also reduce the weight and axial length of the phaser, an important customer acceptance criterion, and improve the speed of response. Further, the proportions of some parts are altered such that all radial and axial loads are borne by a single large bearing in place of two small sequential bearings in the prior art phaser, thus reducing variability in axial alignment of the component parts.

7 Claims, 8 Drawing Sheets

SPLINE-TYPE CAM PHASER

TECHNICAL FIELD

The present invention relates to a cam phaser apparatus for controllably varying the phase relationship between the crankshaft and the camshaft of an internal combustion engine; more particularly, to a cam phaser having concentric splined elements counter-rotatable by a splined piston therebetween; and most particularly, to a splined cam phaser wherein the parts are optimized for ease and economy of manufacture, reduced phaser size, and improved phaser performance.

BACKGROUND OF THE INVENTION

Splined cam phasers are well known in the automotive art; see, for example, U.S. Pat. No. 5,588,404. In principle, a phaser assembly is relatively simple. A first rotatable element is fixedly mounted to the end of a camshaft of an engine and turns synchronously therewith. The first element has helical splines on its outer surface. A second rotatable element surrounds the first element concentrically and has a drive wheel, pulley, or sprocket adapted to be driven by the crankshaft of the engine. On its inner surface, the second element has helical splines opposite-handed from the splines on the first element. A generally cylindrical piston is positioned in a closed annular space between the two elements. The piston has helical splines on both its inner surface and its outer surface which mesh with the splines on the first and second elements. The piston is controllably driven axially in either direction by programmably-directed hydraulic pressure against one or the other side of the piston, causing the first and second elements to counter-rotate with respect to each other and thereby varying the relative timing of the valves with respect to the pistons by changing the rotational phase relationship between the crankshaft and the camshaft. Preferably, the first element is provided at its outer end with a sectored timing wheel, also referred to herein as a target wheel, to permit automatic monitoring of the cam position at all times.

The prior art cam phaser can be difficult and expensive to manufacture. Typically, all moving parts are individually machined from steel forgings. The target wheel, which carries the compressive force of the major assembly bolt, is optimally formed by investment casting, a very expensive forming method. The layout of the parts and seals does not lend itself to formation by less expensive known methods, for example, by powdered metal forming, preferably by powdered steel. Further, the internal passages in various parts, required to present hydraulic fluid to one or the other face of the piston, typically are formed labor-intensively by cutting and drilling.

Therefore, what is needed in the art is an improved splined cam phaser wherein the cost of manufacture is minimized by minimizing the number of machined parts. What is also needed in the art is an improved splined cam phaser wherein the alignment of first and second elements is controlled by a single axial bearing therebetween.

Further needed in the art is an improved splined cam phaser wherein the axial length is reduced.

Still further needed in the art is an improved splined cam phaser wherein the speed of response is improved.

Finally, what is needed in the art is an improved splined cam phaser wherein the position of the cam shaft sprocket relative to the crank shaft can be set after assembly of the splined cam shaft phaser.

SUMMARY OF THE INVENTION

Briefly described, an improved splined cam phaser in accordance with the invention comprises four assemblies: a sprocket assembly, an inner hub assembly, a cover assembly, and a piston assembly. The joined assemblies provide an improved phaser function over that of the prior art phaser. The component parts of the assemblies are re-configured from the analogous parts of the prior art phaser to permit much of the improved phaser to be manufactured inexpensively by powdered metal forming or by stamping from sheet metal, in contrast with a prior art cam phaser wherein all parts are formed expensively either by machining from forged blanks or by investment casting. These changes reduce the cost of manufacture, reduce the weight and axial length, and improve the speed of response, all of which are important customer acceptance criteria. In addition, the irregularly shaped and larger capacity oil passages of the present invention, which require no machining after forming, permit further improvement in speed of response time of the phaser assembly. Further, the proportions of some parts are altered such that all radial and axial loads are borne by a single bearing, rather than the two bearings as in the prior art phaser, thereby reducing variability in axial alignment of the component parts.

The present invention overcomes the problems of the prior art by providing a cam phaser with a lighter, less expensive sheet metal cover. The invention uses a sheet metal cover to replace the conventional cast and machined cover by rearranging the load distribution of the cam phaser. Instead of the cover bearing the load, the invention places the load on an inner hub. With the load redistributed, the cover is made with less expensive materials and processes. In the preferred embodiment, the cover is made of sheet metal or net casting. The cover, while providing a seal for the pressure chamber that actuates the piston, no longer bears the load of the camshaft. A target wheel, also of sheet metal, is an optional component that is be mounted on the outside of the cover. The target wheel has indicia for generating signals representative of the angular position of the cam phaser. Those signals are used to control the setting of the angle of the cam phaser.

With the present invention all the components of the cover and the inner hub are net shaped as originally manufactured thereby eliminating the cost of additional machining. The added machining of o-ring grooves is also eliminated. Likewise, targets are net cast into the sheet metal cover or are easily stamped rather than machined into a cast cover.

Further, with the present invention the manufacturing of the piston is simplified and the cost reduced by eliminating the need to machine grooves for the seals in the piston skirt.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DESCRIPTION OF THE PREFERRED EMBODIMENT

The improvements and benefits conferred by a cam phaser in accordance with the invention may be best understood by first considering a prior art cam phaser.

Figure 1:
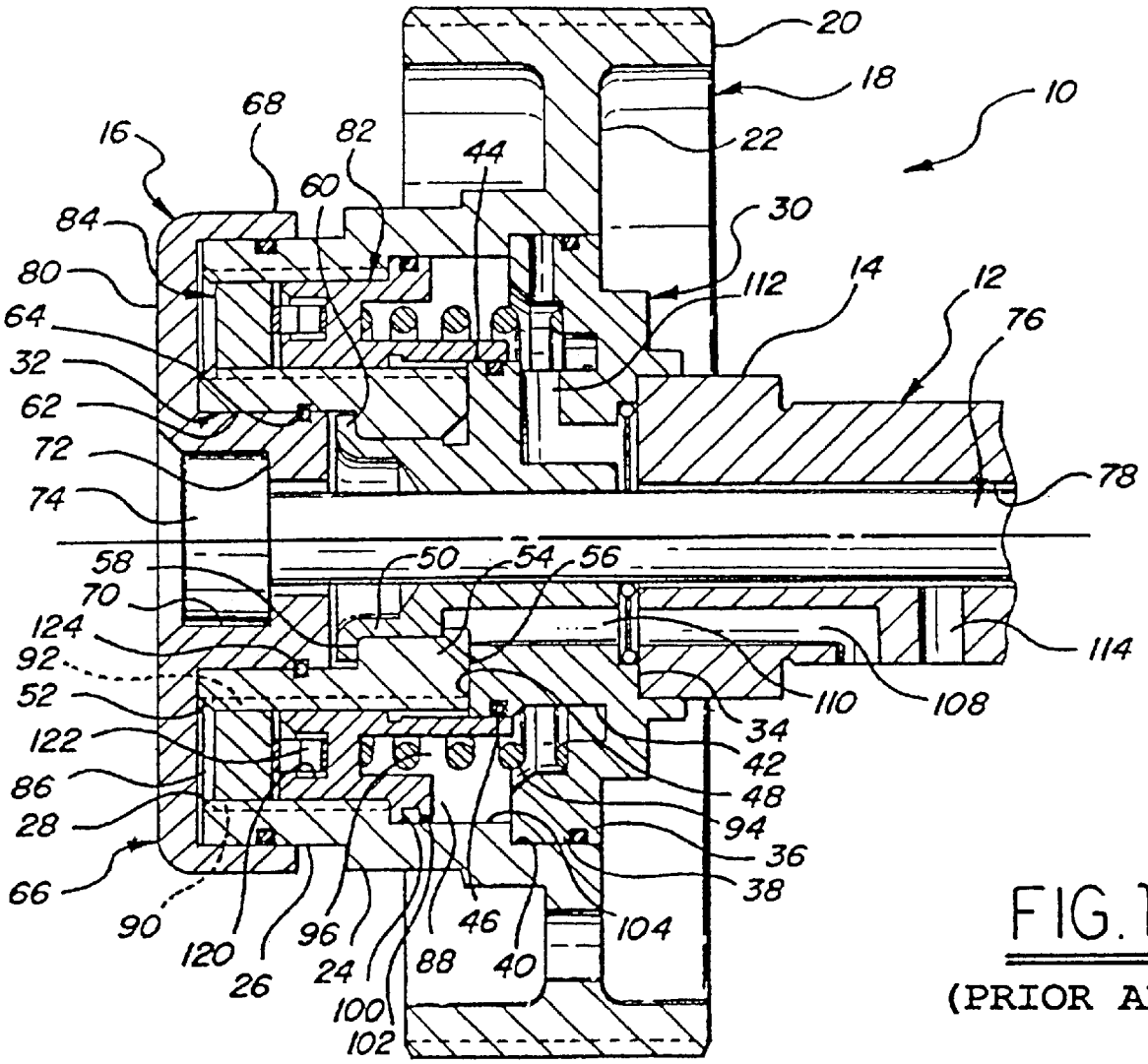
FIG. 1 (PRIOR ART)
FIG. 1 is a cross-sectional view of a prior art spline-type cam phaser substantially as disclosed in U.S. Pat. No. 5,588,404.
Figure 2:
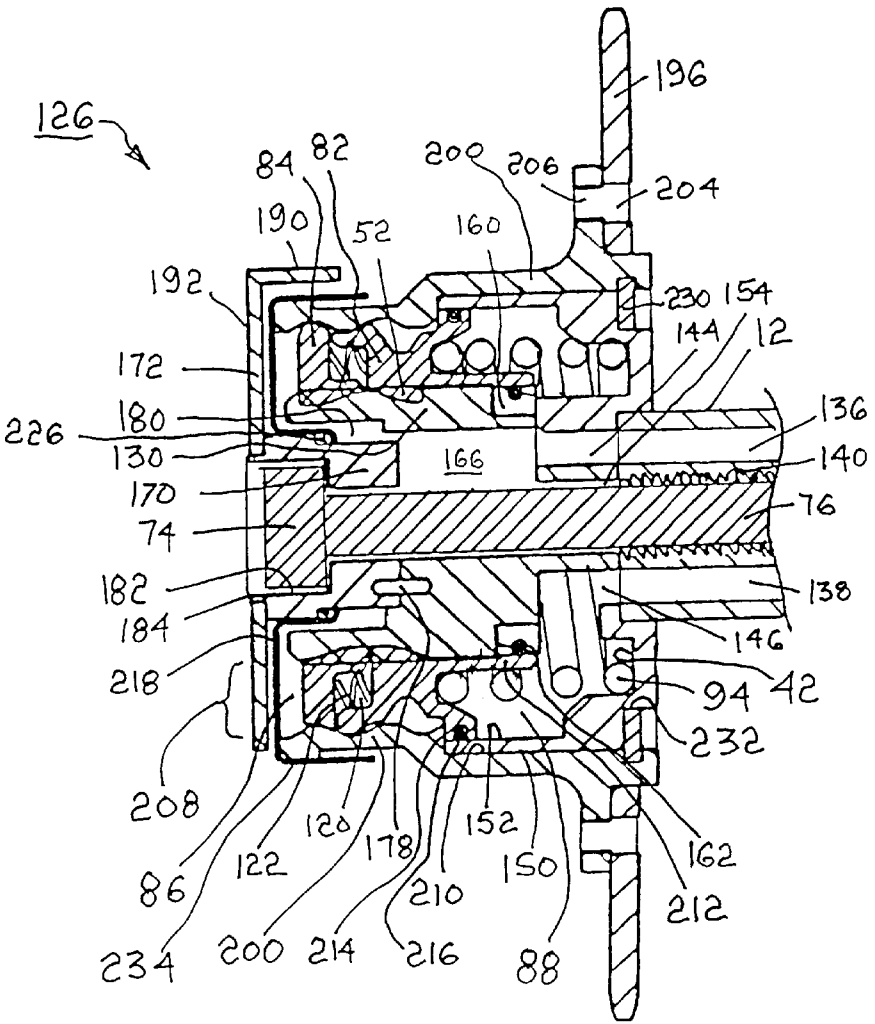
FIG. 2 is a cross-sectional view of an improved spline-type cam phaser in accordance with the invention.

Referring to FIG. 1, numeral 10 generally indicates a portion of the valve gear of an internal combustion engine including a camshaft 12 conventionally carrying a plurality of valve-actuating cams (not shown) and mounted for rotation in the cylinder head or other portion of a multi-camshaft engine (not shown). Camshaft 12 includes at one end an enlarged cylindrical journal 14, which may be a bearing journal, on the end of which is fixedly mounted a prior art variable cam phaser 16 formed in accordance with the prior art, substantially as disclosed in U.S. Pat. No. 5,588,404 issued Dec. 31, 1996 to Lichti et al., the relevant disclosure of which is hereby incorporated by reference.

Cam phaser 16 includes an outer drive member in the form of a pulley 18 (although a chain sprocket, gear, or other suitable drive device could equally well be used). The pulley 18 includes an outer rim 20, adapted to be driven by a toothed timing belt (not shown). As the belt drives pulley 18, the cam phaser 16 transfers its rotary motion to the camshaft 12. The angular position of the cam phaser 16 with respect to the camshaft is adjusted to vary the opening and closing of the valves. That adjustment is made to increase or reduce horsepower and/or fuel efficiency. Rim 20 is connected by a web 22 with a tubular portion 24 extending axially to one side of the web and having at an outer end a cylindrical external bearing surface 26. Within the portion 24 and extending from the outer end adjacent bearing surface 26 are internal right hand helical splines 28.

Pulley 18 is supported for relative rotation upon a coaxial driven hub assembly comprising an assembly of a hub flange 30 and a hub 32. The hub flange includes an end having a circular recess 34 in which the end of the camshaft journal 14 is received. A flange 36 extends outwardly from the recess 34 and terminates outwardly in an enlarged cylindrical journal 38 that slidably engages an internal bearing surface 40 of tubular portion 24. Adjacent to the flange 36 and opening away from the camshaft 12, the hub flange 30 includes a recess 42 adjacent an external guiding surface 44 containing a piston seal ring 46. Adjacent the guiding surface 44, a shoulder 48 extends inwardly to a smaller diameter tubular portion 50 on which the hub 32 is supported.

Hub 32 comprises a tubular body provided, on an outer diameter, with external left hand helical splines 52. On its inner diameter, hub 32 includes a raised portion 54 carried by tubular portion 50, an end face 56 engaging the shoulder 48, and an annular shoulder 58 that is engaged by an outwardly flared flange 60 formed by a thin wall end of the tubular portion 50 of the hub flange. Further outward, in the direction away from the camshaft, the hub 32 inner diameter forms a slightly enlarged internal locating surface 62 having a retaining groove 64 toward its inner end.

An annular cover 66 having a central opening and a generally U-shaped annular cross-section is mounted on the outer ends of the hub 32 and tubular portion 24. The cover includes an outer wall 68 with an inner surface engaging the bearing surface 26 of the tubular portion 24 and an inner wall 70 having an outer surface engaging the internal locating surface 62 of the hub. An inward extension of the inner wall forms a shoulder 72 against which is clamped the head 74 of a central fastener in the form of an attaching bolt 76. The bolt extends through openings in the cover 66 and the hub flange 30 into a hollow center 78 of the camshaft 12 wherein it is threadably engaged in a manner not shown. An annular end wall 80 of the cover extends between the outer and inner walls 68,70 and encloses an annular space within the cam phaser. Within this space are located a first annular phase control piston 82 and a second annular lash control piston 84.

The first piston 82 divides the annular space into an annular pressure chamber 86 adjacent the cover 66 and an annular return chamber 88 between the flange 36 and the piston 82. Piston 82 includes a ring of external right hand helical splines 90 engaging the internal splines 28 within the tubular portion 24 of the pulley.

Additionally, there is a ring of internal left hand helical splines 92 that engage the external helical splines 52 of the hub 32. Accordingly, axial motion of the piston 82 causes a change in the angular orientation or phase relation between pulley 18 and the hub 32, as well as the associated camshaft 12 to which the hub is attached. Changing the phase relationship produces a corresponding change in the time when the valves open and close.

A large helical coil compression spring 94 is seated against the flange 36 of the hub flange and is received in a recess 96 of the piston 82 for biasing the piston in a direction toward the annular cover 66, tending to return the camshaft to a predetermined position, such as a retarded or advanced position for valve actuation. The spring 94 lies within the return chamber 88 formed on the camshaft side of the piston. A piston seal ring 100 seated in a groove in a guiding surface 102 of the piston 82 engages a cylinder surface 104 within the tubular portion 24 of the pulley 18. Piston seal ring 100 and piston seal ring 46 in the guiding surface 44 of flange 60, which engages a cylindrical surface of the piston, limit the leakage of oil between the pressure chamber 86 and the return chamber 88.

Piston 82 alters the phase of the camshaft. When piston 82 moves in a direction against the bias of spring 94, it retards the camshaft timing, by forcing pressurized engine oil (or hydraulic fluid) through passages 108 in the camshaft and 110 in the hub flange which communicate with drain passage 114 in the camshaft. Passage 112 is connected to a pressurized oil supply for forcing piston 82 in an advance direction. Suitable seals are provided to prevent the leakage of pressure and drain oil from the interior of the cam phaser to external surfaces of pulley 18.

The annular lash control piston 84 is located in the pressure chamber 86 between the piston 82 and cover 66. This piston includes external and internal helical splines like those of piston 82 and also engaging the corresponding splines 28,52 of the pulley and hub respectively. The splines of the two pistons are preferably formed with machined end surfaces of the pistons in engagement with one another so that the helices of the splines are continuous when the pistons are engaged. An annular groove 120 in the phase control piston 82, opening toward the facing surface of the lash control piston 84, receives a cylindrical compression spring, preferably in the form of a wave spring 122. Spring 122 urges the lash control piston 84 away from the phase control piston 82 and takes up the lash in the splines between the associated pulley and hub. In this lash control action, the pistons 82,84 function in the same manner as known split gears used for lash control in gear drives.

Prior to assembly of the cam phaser, the hub flange 30 has its tubular portion 50 extending axially. This component is then assembled together with the hub 32, pistons 82,84, and pulley 18. Hub 32 is not fixed to the hub flange but is rotatable on the tubular portion 50, so that the pulley 18 with splined pistons and hub may be rotated relative to the hub flange 30 in order to properly time the pulley to the hub flange with the compression spring 94 fully extended. The outer end of the tubular portion 50 is then deformed, such as by staking or rolling, to form the flange 60 shown in FIG. 1. Flange 60 engages shoulder 58 of the hub, locking the components in their desired orientations. The cover 66 may then be installed and is retained by a retaining ring 124 until assembly of the unit to an engine camshaft.

Thereafter, the pre-timed mechanism is installed on a camshaft 12 as in FIG. 1. A conventional pin (not shown) may be used to orient the hub flange 30 to the camshaft for proper timing. Bolt 76 is threaded through the openings into the camshaft and tightened so as to lock the cover, hub, hub flange, and camshaft elements into fixed relation. This manner of assembly permits the manufacture and assembly of the splined components to be carried out without regard to any requirement for orientation or fixed relation of the internal and external splines other than the splines on the two pistons which are formed together. This allows timing of the elements to be conducted only after assembly of the mechanism components in the manner just described.

Figure 4:
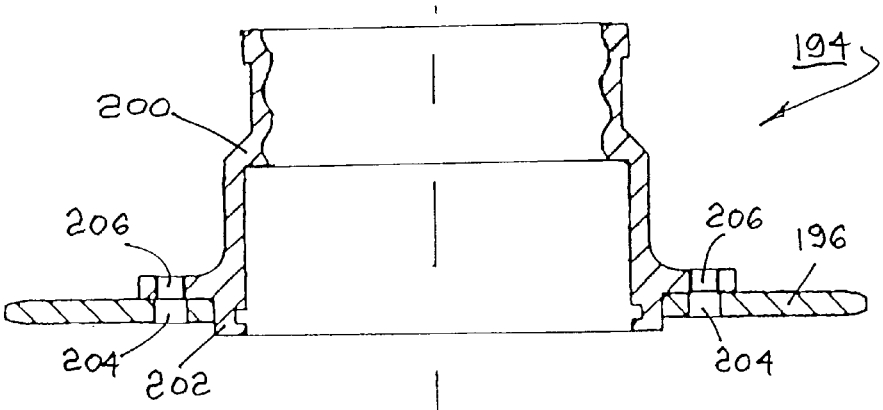
FIG. 4 is an assembled cross-sectional view of the exploded sprocket assembly shown in FIG. 3.
Figure 5:
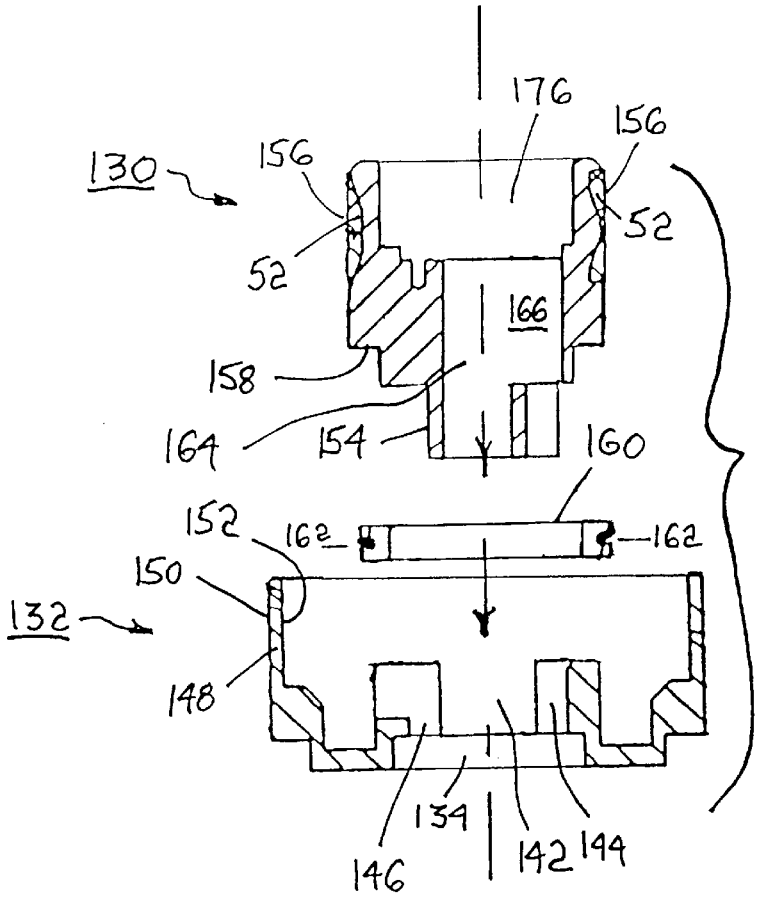
FIG. 5 is an exploded cross-sectional view of the inner hub assembly of the cam phaser shown in FIG. 2.
Figure 6:
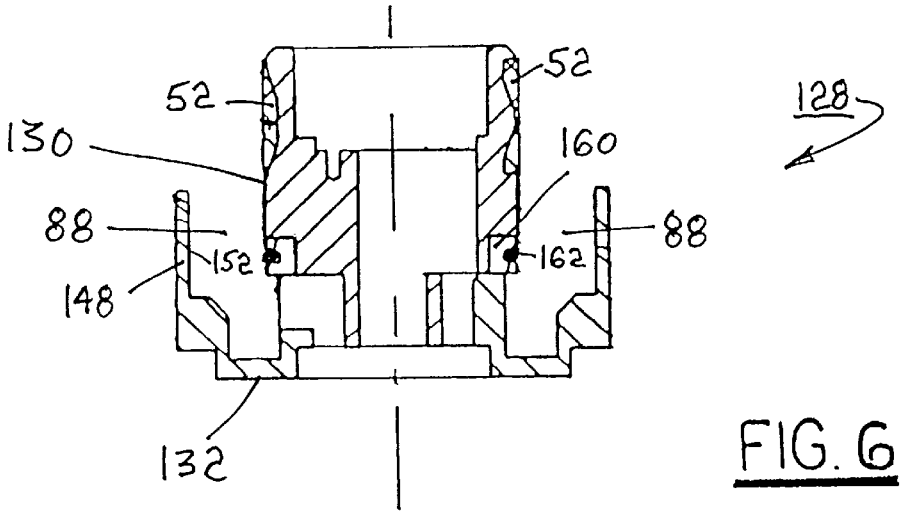
FIG. 6 is an assembled cross-sectional view of the exploded inner hub assembly shown in FIG. 5.

Referring to FIGS. 2–14, an improved splined cam phaser 126 embodying the invention includes a generally tubular inner hub assembly 128 comprising a generally cylindrical inner hub 130 and a hub flange 132. See FIGS. 5 and 6. The hub flange 132 includes a recess 134 for receiving the flat end of a camshaft 12 having advance and retard oil passages 136,138 formed therein and a central threaded bore 140 for receiving bolt 76 to mount the inner hub assembly 128 onto the camshaft 12. The hub flange 132 has an oversize central bore 142 for passage of the bolt 76 and first and second passages 144,146 mating with the advance and retard oil passages 136,138, respectively in the camshaft 12 to admit oil to the advance and retard oil galleries of phaser 126. The hub flange 132 has a cylindrical outer wall portion 148 having an axially extensive outer guide surface 150 and an axially extensive inner piston guide surface 152. The oversize bore 142 in the hub flange is sized to receive in interference fit a boss 154 on the inner hub 130, the boss sealably mating with the end of the camshaft 12 to prevent leakage between the oil supply passages 136 and 138. A portion of the inner hub 130 distal from the camshaft comprises a longitudinal gear 156 having external left hand helical splines 52. A shouldered step 158 in the inner hub adjacent the gear 156 receives a formed ring 160 for retaining an inner piston seal 162. The axial bore 164 in inner hub 130 is assymetrically enlarged through its distal portion to provide an oil passage 166 to the pressure chamber, as discussed below. The inner hub 130 and hub flange 132 are press fit together to define an annular return chamber 88 therebetween, as shown in FIGS. 5 and 6. The hub flange 132 is configured so that it may be easily formed inexpensively by powdered metal forming in known fashion, such forming including net shaping of the oil passages 144,146. The inner hub 130 is preferably formed by machining of a forged blank and can be alternately formed from powdered metal.

Figure 8:
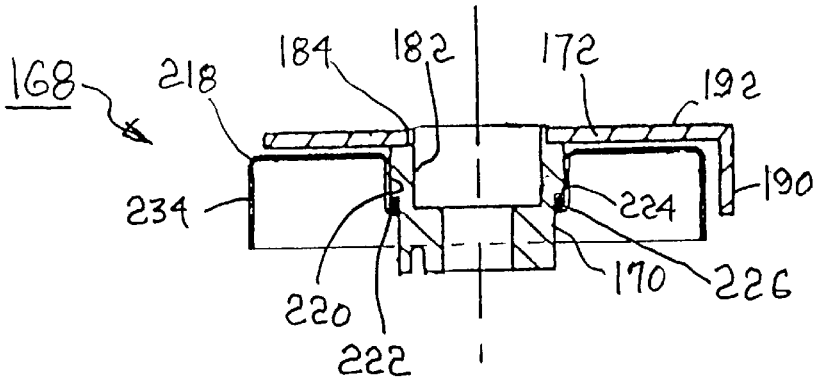
FIG. 8 is an assembled cross-sectional view of the exploded cover assembly shown in FIG. 7.
Figure 7:
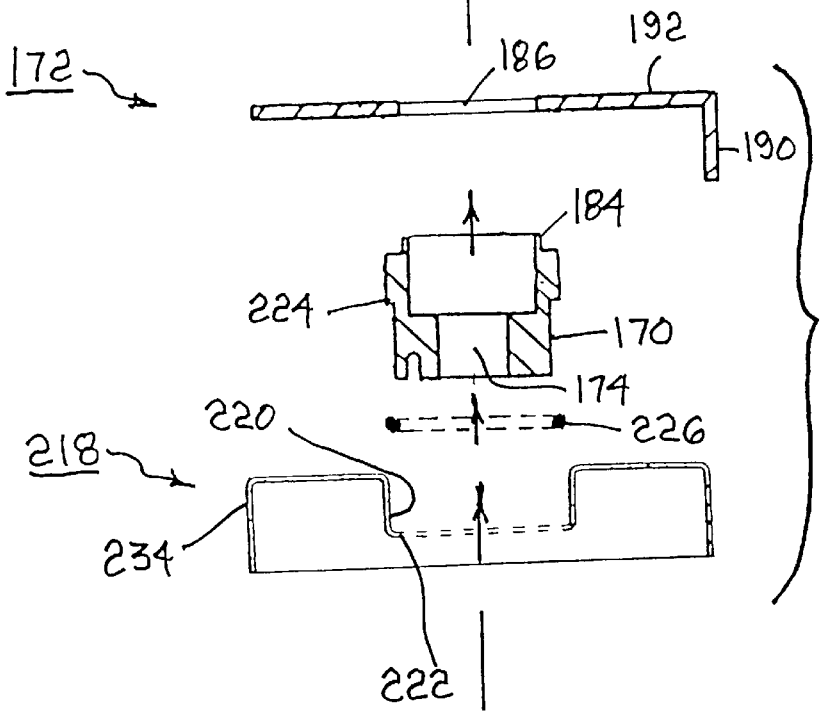
FIG. 7 is an exploded cross-sectional view of the cover assembly of the cam phaser shown in FIG. 2.
Figure 12:
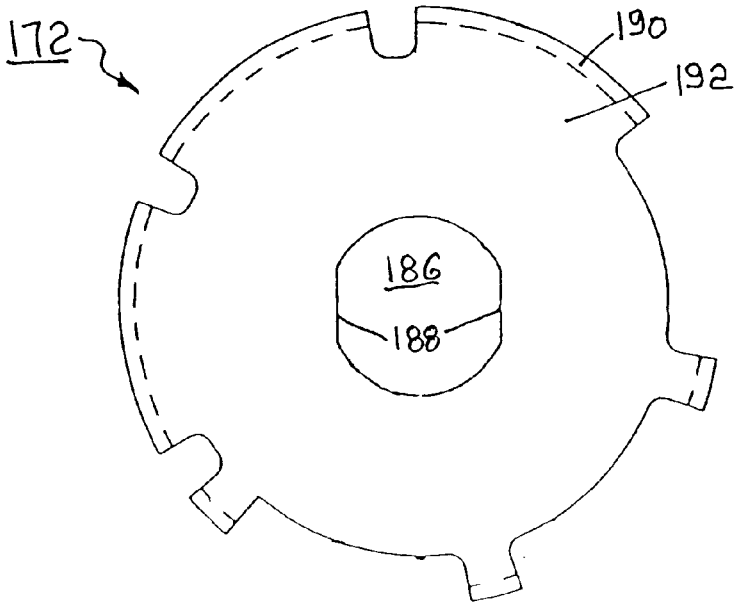
FIG. 12 is a plan view of a target wheel shown in FIG. 7.

In the present invention, the several functions of prior art annular cover 66 are divided among several inexpensively formed new components which are assemblable into a cover assembly 168 which is less expensive to manufacture than investment-cast cover 66. Cover assembly 168 comprises an outer hub 170 and cover 218, and an optional timing wheel 172 as shown in FIGS. 7 and 8. The outer hub 170 has an axial bore 174 for accommodating bolt 76 and is supported concentrically within a wider-diameter outer portion 176 of the inner hub 130, to which it is attached for joint rotation by a pin 178. An annular space 180 between the inner hub 130 and the outer hub 170 defines an annular passage for pressurized oil from the assymetric axial bore 164 in the inner hub to the pressure chamber. The outer hub 170 is provided with an axial outer recess 182 for receiving the head 74 of the bolt 76 and with a short axial boss 184 having parallel sides surrounding the recess for receiving timing wheel 172 which is preferably stamped from sheet steel. Timing wheel 172 permits continuous measurement of the phase of the camshaft relative to the crankshaft by an external sensor (not shown). The timing wheel 172 has a non-circular central opening 186 having parallel sides 188, as shown in FIG. 12, which is matable with the boss 184 on the outer hub 170. The timing wheel 172 may have both radial and axial flange portions 190,192 as desired, and is readily and inexpensively formed by stamping or deep drawing from sheet metal. The outer hub 170 is also configured for inexpensive and reliable forming by powdered metal techniques. The cover 218 is provided with a central recess 220 which surrounds the outer hub 170 and which has a lip 222 for engaging a step 224 on the outer hub 170. Preferably, an O-ring 226 is captured between lip 222 and step 224 to provide a rotating seal of the pressure chamber 86. The cover 218 is readily and inexpensively formed by stamping or deep drawing from sheet metal.

An advantage of the present cam phaser configuration is that the juncture of the cover with the sprocket flange is no longer a rotary bearing which can adversely affect axial alignment. Prior art cover 66 is fixed to the camshaft by bolt 76 and rotates therewith against hub flange 24 (surface 26 in FIG. 1). Cover 66 serves also as a timing wheel. In the present invention, cover 218 is fixed to the sprocket flange 200 and instead rotates with the sprocket and crankshaft, there being a new rotary seal 226, such as an o-ring, between cover 218 and outer hub 170. Outer hub 170 bears the axial load formerly borne by cover 66. This improvement, and the associated reduction in fabrication costs of the improved timing wheel assembly, is possible because there is no secondary axial guiding surface 26 as in prior art phaser 16, due to the axially longer primary guiding surface 150/210 formed in inner hub assembly 128 and sprocket assembly 194, respectively, as discussed in more detail below.

Figure 3:
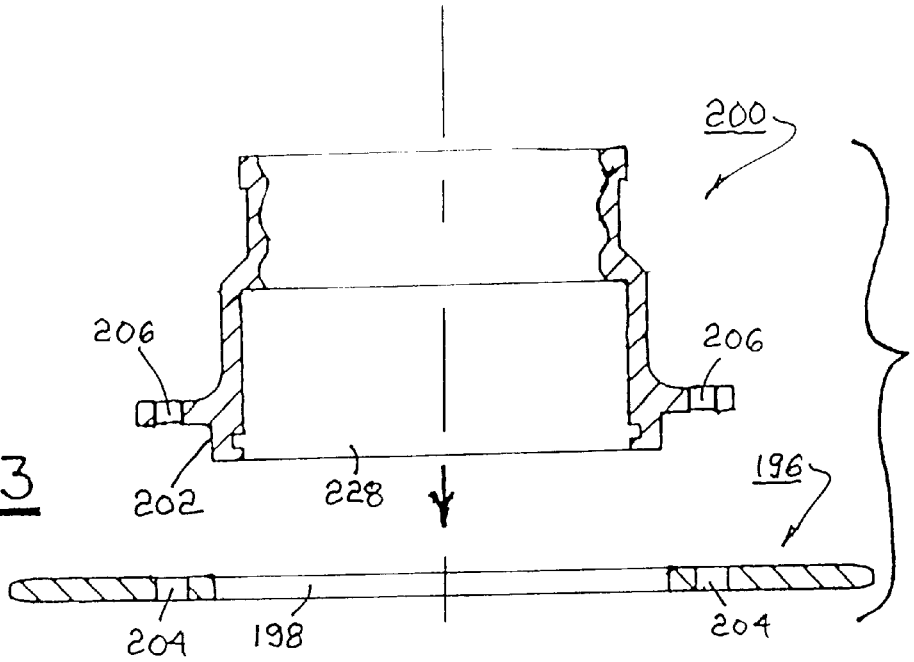
FIG. 3 is an exploded cross-sectional view of the sprocket assembly of the cam phaser shown in FIG. 2.
Figure 9:
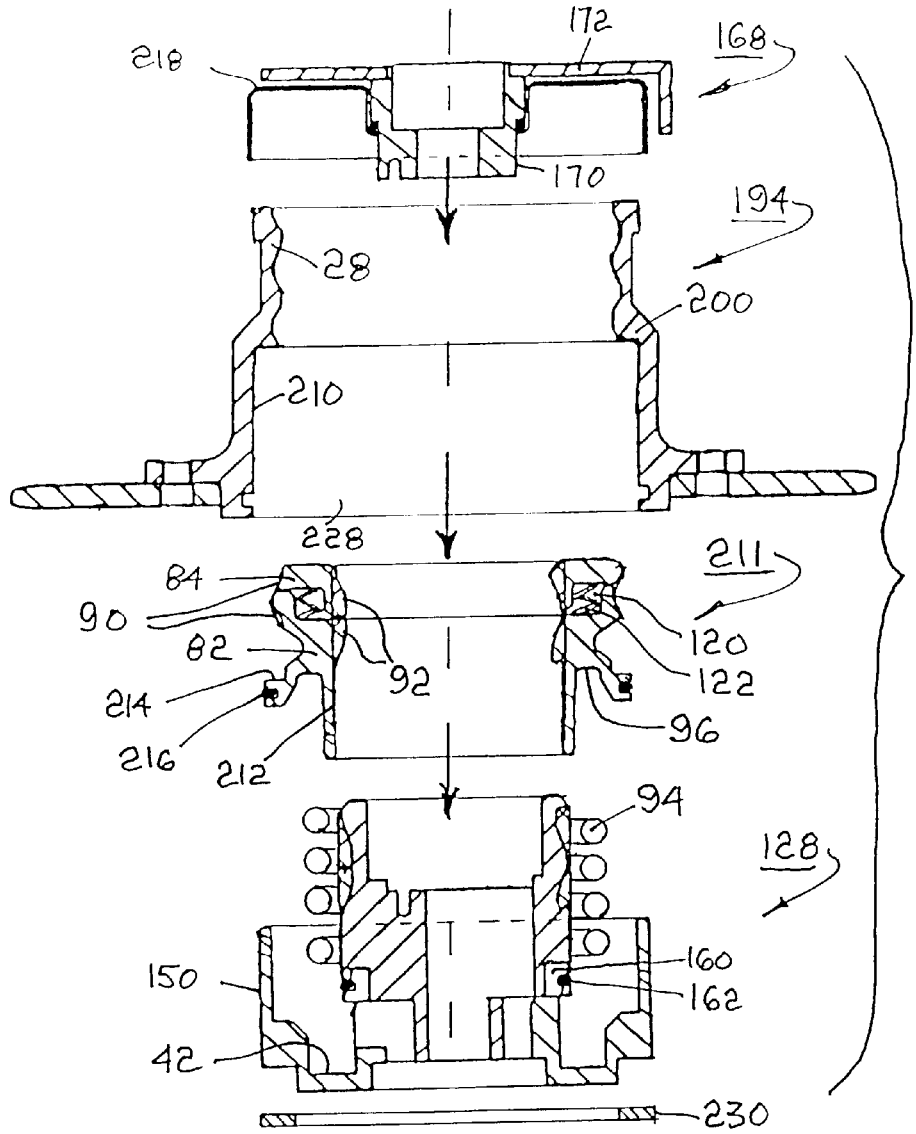
FIG. 9 is an exploded cross-sectional view of the cam phaser shown in FIG. 2, showing the combining of the assemblies shown in FIGS. 4, 6, and 8 with a piston assembly.
Figure 10:
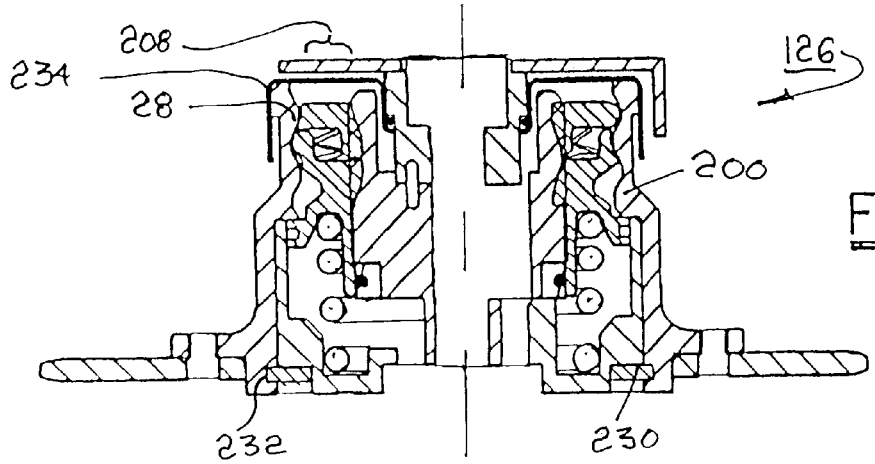
FIG. 10 is an assembled cross-sectional view of the exploded assemblies shown in FIG. 9, FIG. 10 being substantially identical with FIG. 2.
Figure 11:
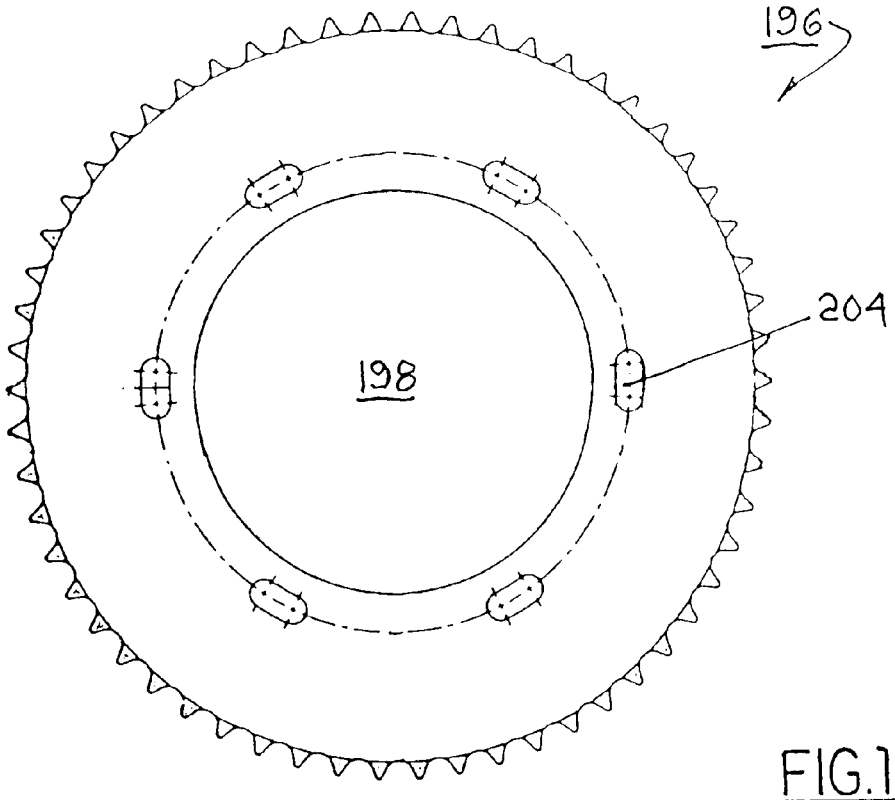
FIG. 11 is a plan view of a sprocket wheel shown in FIG. 3.

Concentrically surrounding the inner hub assembly 128 is a sprocket assembly 194 comprising a generally flat toothed sprocket wheel 196 for receiving a timing chain (not shown). The sprocket assembly has a central opening 198 and a generally cylindrical sprocket flange 200 having a shouldered portion 202, as shown in FIG. 3. The portion 202 is fit into the sprocket wheel opening 198 to form the sprocket assembly 194, as shown in FIG. 4. The sprocket wheel 196 is provided with a plurality of holes 204 for bolting the wheel to the flange via matching holes 206 in flange 200. Preferably, the holes in the sprocket wheel are radially slotted to permit precise timing adjustment of the phaser by slight rotation of the sprocket wheel past the sprocket flange during final assembly. As shown in FIG. 9, during assembly, the sprocket flange 200 is disposed radially apart from the inner hub assembly 128 to form an annular space 208 therebetween, as discussed further below. The sprocket flange 200 is preferably formed by machining of a forged blank. The sprocket wheel 196 is readily formed inexpensively by known powdered metal forming techniques, wherein powdered metal is compressed and solidified in a mold to yield a rigid, durable part.

A portion of the inner wall of the sprocket flange proximal to the camshaft is a smooth cylindrical guiding surface 210 for rotatably mating with the cylindrical outer surface 150 of the hub flange 132 to form an axially-extensive single bearing for carrying all imposed radial loads and for maintaining axial alignment of the hub assembly and the sprocket assembly. The portion of the inner wall of the sprocket flange distal from the camshaft is provided with internal right hand helical splines 28.

In the annular space 208 between the sprocket flange and the hub assembly is disposed a piston assembly 211 comprising an annular phase control piston 82 and an annular lash control piston 84. The pistons are provided on their outer and inner surfaces, respectively, with external right hand helical splines 90 and internal left hand helical splines 92 for meshingly engaging the corresponding splines 28,52 on the sprocket flange and the hub assembly, respectively. An intermediate annular chamber 120 between the pistons holds a wave spring 122 for urging the pistons apart to take up lash in the splines. The pistons divide the annular space 208 into an annular pressure chamber 86 and an annular return chamber 88. The phase control piston 82 has an inner skirt 212 which is slidably sealed against the piston seal 162 in the seal ring 160, and an outer seal ring 214 and outer piston seal 216 which is slidably disposed against the inner guide surface 152 of the outer wall portion 148. The pressure chamber 86 is closed by the inverted cup-shaped cover 218 which is an element of the cover assembly 168 which is sealingly attached as by crimping to the outer end of the sprocket flange 200.

Figure 13:
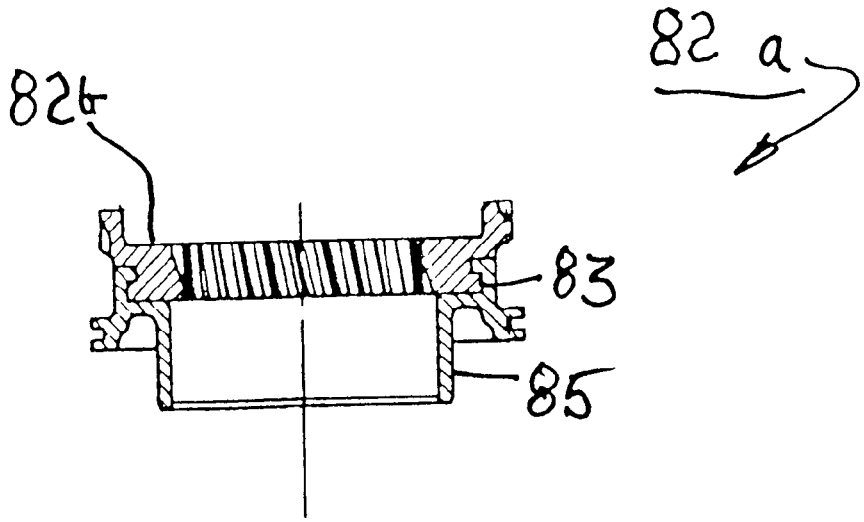
FIG. 13 is a cross-sectional view of an alternative embodiment of a phase control piston wherein a non-load-bearing portion of the piston is formed from a plastic polymer.
Figure 14:
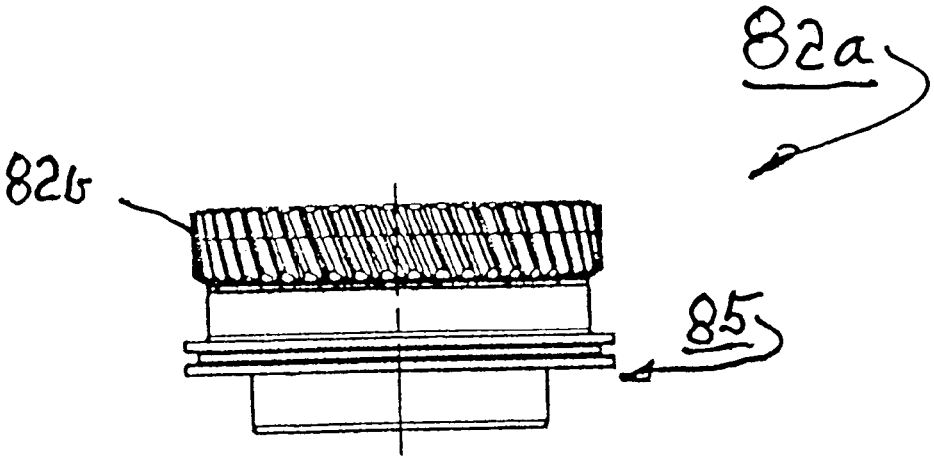
FIG. 14 is an elevational view of the phase control piston shown in FIG. 13.

Referring to FIGS. 13 and 14, the cost and weight of annular phase control piston 82 may be reduced by substituting a moldable plastic polymer, for example, Nylon 6/6 available from E.I. DuPont de Nemours, Wilmington, Del. USA, for a non-load-bearing portion of the piston. In alternative embodiment 82*a*, the load-bearing splined portion 82*b* is machined from a forged metal blank, as in piston 82, but without the skirt portion. A flange 83 is provided as a lock for plastic skirt 85 which is conveniently overmolded onto piston 82*b* in known insert molding fashion to yield embodiment 82*a*.

Within the return chamber 88 is disposed a helical coil compression spring 94 for biasing the pistons to a full advance position. The spring 94 is seated at its proximal end in an annular recess 42 in the hub flange and at its distal end in an annular recess 96 in the phase control piston.

To complete fabrication of the improved phaser 126, as shown in FIG. 9, the piston assembly 211 and compression spring 94 are installed onto the inner hub assembly 128 and the two assemblies are inserted into the sprocket assembly 194 through the central opening 228 in the sprocket flange 200. A snap ring 230 is installed in the groove 232 formed between the sprocket flange 200 and the hub flange 132 to retain the inner hub assembly 128 in the sprocket assembly 194. The cover assembly 168 including the O-ring 226 and cover 218 is inserted into the recess 176 (FIG. 5) in the inner hub assembly 128, the two assemblies being rotationally aligned to permit a pin 178 to be inserted therebetween. The radial flange 234 on the cover 218 is then sealed to the sprocket flange 200 as by roll crimping or welding. The cover 168 is retained in the phaser by bolt 76.

A splined cam phaser in accordance with the invention has several important advantages over the prior art cam phaser. First, an inner hub assembly 128 that includes a separate hub flange 132 and an inner hub 130 replaces the complex conventional hub flange 30. The prior art hub flange 30 is entirely machined from a complex forged blank and is very expensive to fabricate. The present inner hub 130 is also machined from a forging, but the forging is much less complex and the machining is much less expensive. The inner hub 130 is configured to permit powdered metal forming, at significant savings in fabrication cost.

Second, the axially short external guiding surface 44 on the prior art hub flange 30 is reconfigured as an axially extensive external guiding surface 150 on hub flange 132. The axial length is sufficient that all radial loads may be borne on this one bearing surface, eliminating the need for a second external bearing surface 26 as on the prior art hub flange 30. In the prior art phaser 16, variances in the first and second bearings are additive, whereas in the improved phaser all variance is contained in a single bearing. Thus, total bearing variance is reduced and axial alignment of the component parts is significantly improved.

Third, the hub flange 132 is conveniently configured such that the oil passages 144,146 are net formed in the flange during powdered metal fabrication thereof, thus eliminating the complex and expensive drilling and machining of oil passages required by the prior art hub flange. As the oil passage are net formed, no secondary or finish machining is required, thus reducing cost.

Fourth, eliminating the second bearing removes the need for great structural strength and rigidity in annular cover 66, which is also needed to support the axial load imposed by the bolt head 74 without being deformed. Cover 66 is formed very expensively by investment casting. In phaser 126, cover 66 is reconfigured as cover assembly 168 having three separate parts: the outer hub 170, the cover 218, and the optional timing wheel 172. The cover and timing wheel are readily stamped, punched, or deep drawn by a shaped ram or form from sheet metal in known fashion, and the outer hub is readily formed by powdered metal forming, all at a great reduction in cost over prior art cover 66. Axial length of the phaser is also reduced by obviating the need for a thick cover. Reduction in mass of the cover also reduces inertia and thus improves speed of response of the phaser.

Fifth, the inner piston seal is provided by a separate grooved ring 160, for supporting seal 162, the ring being pressed into a shouldered step 158 in inner hub 130. This permits easy machining of the inner hub to form the hub splines 52 before installation of the ring with no required allowance in length of the inner hub to accommodate a machining transition zone between the splines and the seal groove. This improvement reduces the minimum axial length of the phaser.

Sixth, an integral O-ring groove to accommodate an O-ring 226 as an inner seal to the annular pressure chamber 86 is formed between a step 224 on the outer hub and the lip 222 on the cover. Thus, the need to machine an o-ring groove to seal the the annular pressure chamber is eliminated.

Seventh, timing of the phaser can be performed after assembly by relative rotation of the sprocket wheel 196 and sprocket flange 200 as described above. Thus, no post assembly staking of the outer hub to the inner hub, as in the prior art phaser, is required.

Eighth, the annular phase control piston is formed partially of a plastic polymer to reduce cost and weight.

It will be seen from the above that, in contrast with the prior art cam phaser, only the splined components of the improved cam phaser are formed by machining from forged blanks (the inner hub, the sprocket flange, and the two pistons). All other structural parts are be formed by other inexpensive processes from inexpensive starting materials, thus reducing the cost of manufacture, improving ease of assembly, reducing size and weight, and improving response performance.

From the foregoing description, it will be apparent that there has been provided an improved splined cam phaser, wherein the cost and ease of fabrication is very significantly reduced, size is reduced, and speed of response is improved. Variations and modifications of the herein described cam phaser, in accordance with the invention, will undoubtedly suggest themselves to those skilled in this art. Accordingly, the foregoing description should be taken as illustrative and not in a limiting sense.

What is claimed is:

1. A variable cam phaser for attachment to a camshaft of an internal combustion engine for varying the phase relationship between the camshaft and a crankshaft by application of variable force to the phaser, comprising:

a) input drive means for receiving input rotary motion from said crankshaft and for transmitting said input rotary motion to said camshaft;

b) sprocket flange means adjustably mounted to said input drive means and rotatable therewith and having first-handed internal helical splines on a portion of a radial inner surface thereof distal from said camshaft;

c) inner hub flange means connectable to said camshaft for transmitting the rotary motion from said input drive means to the camshaft, said inner hub flange means having a hub portion and a flange portion disposed within said sprocket flange means, said flange portion extending axially over a portion of said radial inner surface of said sprocket flange means proximal to said camshaft to define an axially extensive bearing therebetween, said inner hub flange means having second-handed external helical splines extending into a first annular space opposite said first-handed internal helical splines on said sprocket flange means;

d) outer hub means coupled to said inner hub flange means to define a second annular space between said outer hub means and said hub portion of said inner hub flange means and further a third annular space between said outer hub means and the distal portion of said sprocket flange means;

e) annular piston means disposed within said second annular space and dividing said space into a first compression chamber distal from said camshaft and a second compression chamber proximal to said camshaft, said annular piston means having external helical splines in meshable relationship with said splines on said sprocket flange means and having internal helical splines in meshable relationship with said splines on said inner hub means, said piston means being operable upon application of fluid pressure in one of said first and second compression chambers to move in a direction toward the other of said chambers to act on the splines and thereby radially displace said inner hub flange means and said sprocket flange means with respect to each other to adjust the phase between the crankshaft and the camshaft; and f) a cover assembly including cover means sealably mounted to an outer end of said sprocket flange means and to an outer surface of said outer hub means to enclose said first compression chamber, said cover means having a central opening therethrough for receiving said outer hub means and being connected to said outer hub means for rotation therewith.

2. A variable cam phaser in accordance with claim 1, wherein said input drive means is selected from the group consisting of sprocket wheel, gear, and pulley.

3. A variable cam phaser in accordance with claim 1, wherein at least one of said sprocket flange means, said inner hub flange means, and said annular piston means is formed by machining from a forged blank, and wherein at least one of said input drive means, said outer hub means, and said cover means is formed by a process other than by machining from a forged blank.

4. A variable cam phaser in accordance with claim 1, further comprising a timing wheel disposed coaxially on said outer hub means.

5. A variable cam phaser in accordance with claim 1, wherein said annular piston means includes an annular phase control piston and an annular lash control piston.

6. A variable cam phaser in accordance with claim 1, wherein said inner hub flange means is formed by powdered metal forming and wherein said inner hub flange includes oil passages net shaped in said forming.

7. A variable cam phaser in accordance with claim 1, wherein said inner hub flange means further includes a pressed-on ring for retaining a piston seal for forming a seal against said annular piston means.

* * * * *